United States Patent [19]

Montgomery

[11] 4,287,381

[45] Sep. 1, 1981

[54] ELECTRIC ARC FURNACE ELECTRODES

[75] Inventor: Robert W. Montgomery, Sheffield, England

[73] Assignee: British Steel Corporation, London, England

[21] Appl. No.: 97,632

[22] Filed: Nov. 27, 1979

[30] Foreign Application Priority Data

Dec. 19, 1978 [GB] United Kingdom ..... 49022/78

[51] Int. Cl.[3] ..... H05B 7/08

[52] U.S. Cl. ..... 13/18 C

[58] Field of Search ..... 13/14–17, 13/18 R, 18 A, 18 B, 18 C, 9 R

[56] References Cited

U.S. PATENT DOCUMENTS

| | | | |
|---|---|---|---|
| 3,392,227 | 7/1968 | Ostberg . | |
| 4,121,042 | 10/1978 | Prenn . | |
| 4,168,392 | 0/1979 | Prenn . | |
| 4,189,617 | 2/1980 | Schwabe et al. | 13/18 C |

FOREIGN PATENT DOCUMENTS

| | | |
|---|---|---|
| 867876 | 10/1978 | Belgium . |
| 664298 | of 1952 | United Kingdom . |
| 1371365 | of 1974 | United Kingdom . |

*Primary Examiner*—Roy N. Envall, Jr.
*Attorney, Agent, or Firm*—Bacon & Thomas

[57] ABSTRACT

An electrode for an arc furnace comprising a water-cooled tubular column (2) and dependent therefrom a number of interconnected graphite or carbon sections, the column surrounding and being electrically insulated from one or more bus bars (5,6) extending centrally through the column and connected to a conductive screw-threaded member (7) at one end thereof, one of the graphite sections (13) being secured to the member, and that section, together with the other(s), being secured to one another through graphite nipples (15) having screw-threads of the same size as that of the said member.

15 Claims, 4 Drawing Figures

ELECTRIC ARC FURNACE ELECTRODES

Figure 1:
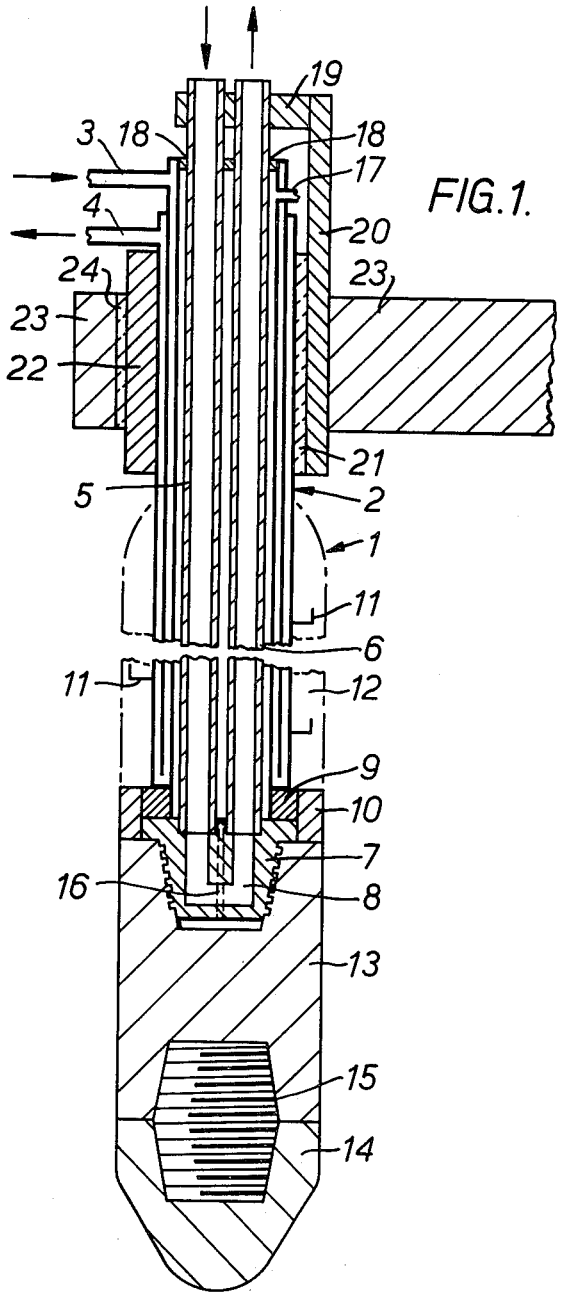

This invention relates to electrodes for electric arc furnaces, more particularly steelmaking furnaces.

In electric arc steelmaking practice the graphite or carbon electrodes employed are consumed not only at the tip where the arc is struck but also along the column as a result of extensive oxidation in the furnace environment. This results in the electrode being consumed in such a manner as to define the characteristic conical configuration at its lower end which results in a more rapid longitudinal wear rate at the tip than would otherwise be the case because of its smaller cross sectional area at this region. Stub end losses, that is the loss occasioned by the stub end of the eroded section breaking away from the next graphite section to which it is secured, are also significant with conventionally fed electrodes—new sections are added to the exposed end of the column protruding from the furnace—bearing in mind that the lower end of the column containing the jointed sections is subject to severe vibration and the harsh environment within the furnace for a considerable period.

Electrode consumption in this fashion accounts for a considerable cost per tone of steel melted by the arc furnace route and efforts have been made hitherto to reduce these losses by applying a protective coating along the length of the column or by water cooling the bulk of the electrode column.

It is the latter aspect with which this invention is concerned.

Hitherto, a variety of different designs of water-cooled electrode have been proposed. U.K. Pat. No. 1,223,162, for example, discloses the use of a tubular ceramic shank having water coolant pipes extending through it, these pipes constituting the electrical connection to the conventional graphite electrode sections. Belgian Patent No. 867,876 discloses a tubular water conduit embedded in a mass of refractory material this conduit again constituting the electrical connection to the graphite and U.S. Pat. No. 4,121,042 discloses an all-metal shank having coaxial waterways. In each of these designs however there is no shield provided around the current conducting member(s)—other than refractory material—and this can present operational drawbacks and dangers in the event of scrap in the furnace hearth fouling the refractory surface layer and bridging the arc.

It is an object of this invention to provide an improved water cooled electrode.

From one aspect the invention provides and electrode for an arc furnace comprising a metal column having a water-cooled tubular structure surrounding and electrically insulated from one or more bus bars extending centrally through the column and connected to a conductive screw-threaded member at one thereof, and a plurality of elongated dependent carbon or graphite sections, one of said sections being secured to the member and that section, together with the other(s), being secured to one another through nipples having screw-threads of the same size as said member.

The screw-threaded member may either be male threaded, engaging with a female threaded graphite section, or it may be female threaded and include a conventional screw threaded nipple which in turn is secured to the graphite section.

Preferably the bus bars are in the form of tubes which are themselves water-cooled, lying within the annular waterway in the tubular structure which effect the major water cooling of the column. This outer water cooling circuit which surrounds the water-cooled bus tubes is insulated from and shields these 'live' elements.

A space may be defined between the outer cooling circuit and the bus tubes into which an inert gas is introduced, this may bleed off through bores in aforesaid member and diffuse through the gas permeable graphite section. The advantages of this are twofold, namely, the issuing gas provides a 'shield' around the electrode column and, more importantly, graphite section breakage or erosion can be detected simply by monitoring the gas pressure, this being aided by providing for the bore to extend part-way through the initially dependent graphite section.

The external surface of the metal electrode column may be refractory clad, at least up to a position near that at which it is held inside a conventional arc furnace electrode clamp, and the electrode column may readily be 'slipped' through the electrode clamp to ensure contact with the furnace charge when operating at the lower limit of vertical movement of the clamp.

From another aspect the invention provides an electrode for an arc furnace comprising a plurality of elongated carbon or graphite sections secured to one another by screw-threaded nipples and a tubular structure water-cooled through inlet and outlet ports surrounding the graphite sections and spaced therefrom by insulating inserts at the upper and lower ends of the structure, said structure being secured either to the furnace roof through which it depends or to an electrode holder and means being provided to advance the graphite sections through the water-cooled tubular structure.

The tubular structure may be made from steel, and, as before, carry a refractory/slag coating on its exposed surface; an inert gas may be injected into the gap between the upper and lower inserts as a sensor.

Where the tubular structure is secured to the furnace roof the graphite sections may be held by and periodically advanced through a clamp in the electrode holder to which bus tubes are connected whereas, where the structure is secured to the holder the graphite sections may be held by and periodically advanced through a separate clamp to which the bus tubes are connected.

In order that the invention may be fully understood some embodiments thereof will now be described with reference to the accompanying drawings, in which:

FIGS. 1 to 4 each illustrates a sectional side elevation through a water-cooled electrode in accordance with different embodiments of this invention.

Referring now to FIG. 1, the electrode column 1 comprises an elongated hollow tubular steel structure 2 which is water-cooled through inlet and outlet ports 3,4. Extending through the centre of this tubular structure is a pair of hollow water-cooled bus tubes 5,6 and these terminate at the lower end in a copper nipple 7 having a U-shaped channel 8 formed in it in alignment with the bus tubes. The nipple is insulated from the structure 2 by a refractory ring 9 about which a further refractory ring 10 is mounted, and the outer wall of this structure has extending from it a plurality of 'hooks' 11 through which a refractory and/or slag coating 12 adheres to this wall.

Depending from the nipple 7 is a standard graphite section 13 from which depends a similar section 14—shown partially eroded to form a conical stub—through a conventional screw-threaded graphite nipple 15 of the same size as the nipple 7.

The nipple 7 has a pair of bores extending through it—only one (16) is visible—through which is bled an inert gas, e.g. nitrogen, which is introduced into the column via a port 17, this gas permeating through the sides of the graphite section 13 providing a gaseous 'shield' in operation.

At the upper end of the structure, the bus tubes are brought out from the electrode body through insulating bushes 18 and are clamped in a copper plate 19 which is attached to two water-cooled copper contact pads 20 (only one of which is shown) which extend downwards parallel with the electrode body. An insulating material 21 is interposed between the contact pads and the electrode body and a steel pad 22 is attached to the electrode body diametrically opposite to the two contact pads. The outer surfaces of the steel pad and the contact pads are machined to a diameter suitable for fitting inside an existing arc furnace electrode clamp 23 but the electrode clamp is modified insofar as a layer of insulation 24 is bonded on the inside of the clamp adjacent to the steel pad of the electrode, so as to electrically insulate that part of the clamp from the electrode. The whole electrode column may be slipped through the clamp by slackening the clamp mechanism, and reclamped insofar as the copper contact pads remain inside the electrode clamp.

In operation, water is injected through the bus tubes and the waterways in the column 2, gas is injected through the port 17, power is applied and an arc is drawn at the bottom end of the graphite section 14 as it is withdrawn from a scrap charge in the normal fashion. With a new electrode column a refractory coating is preferably applied over the hooks 11 but alternatively these may be exposed to trap slag which will rapidly form a protective coating anyway.

When the sections 13 and 14 have eroded to a position close to the copper threaded section 7, the remaining graphite stub is removed and a fresh section is then added to the copper nipple. The graphite stub previously removed is then added to the lower end of the fresh section using a graphite nipple. In this way therefore there is 100% utilisation of the graphite since none is lost other than through erosion during the normal melting procedure. This mechanical function may be performed by a 'robot', either on or off the furnace, capable of withstanding the heat, and since the refractory ring 10 is exposed at this time it may readily be replaced if worn to maintain the integrity of the insulation.

As mentioned the gas bled through the bores 16 permeates through the graphite section 13 and a pressure sensor (not shown) connected in circuit with the inlet port 17 effects a safety function in identifying any significant drop in pressure such as would be occasioned by erosion, breakage or detachment of the section 13.

The generation of eddy-currents in the metal column, which would result in spurious heating and thus reduce the efficiency of the cooled electrode, is avoided by ensuring that the column 2 is made from a non-magnetic material, e.g. austenitic stainless steel or a magnetic material fabricated to minimise induced currents. A further advantage of this electrode design is that since the electrode column is insulated from the supply by the insulating inserts 18, 21, 24, the possibility of scrap striking the column and bridging the arc, e.g. by penetrating through the coating 12, will not cause additional arcing at this point.

Various modifications may of course readily be made to the design shown. For example, the metal column may be strengthened where it is clamped in the holder by the provision of 'spiders' between the inner and outer concentric tubes or by making that part of the column in heavier gauge material. Alternatively, the clamping may be effected on a solid section of the column above the level at which the waterways are formed.

Figure 2:
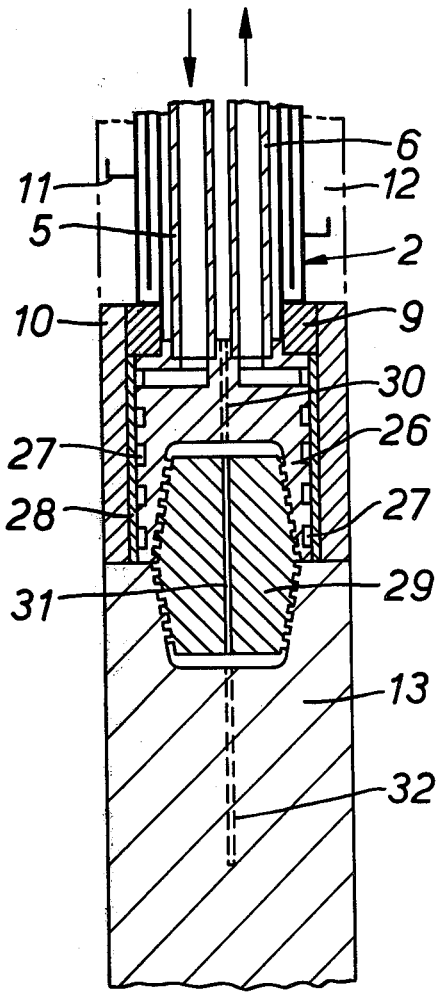

One particularly advantageous alternative design feature is shown in FIG. 2. Here, the bus tubes 5,6 are flared outwardly within a copper socket which replaces the nipple 7. This socket comprises a body portion 26 having two spirally wound channels 27 machined in its outer surface and communicating with the bus-tube waterways in the manner of a two-start thread, the two channels communicating with one another at the lower end so that water travels down one 'thread' and up the other. A copper sleeve 28 isolates the waterways from one another and from direct contact with the surrounding refractory ring. The body portion 26 has a threaded hollowed section to accommodate a threaded graphite nipple 29 and also has a bore 30 extending through it, communicating with a bore 31 for the passage of gas in the manner previously described.

This particular design incorporating a female socket end reduces thermal stresses at the head of the dependent graphite section 13 as compared with the FIG. 1 embodiment.

In both cases the section 13 may be provided with an axially extending blind bore 32 to a depth which defines the minimum length of graphite tip for safe operation. As the graphite erodes away in operation the bore will eventually become exposed and the resultant loss of gas pressure indicates the necessity to change the tip.

Figure 3:
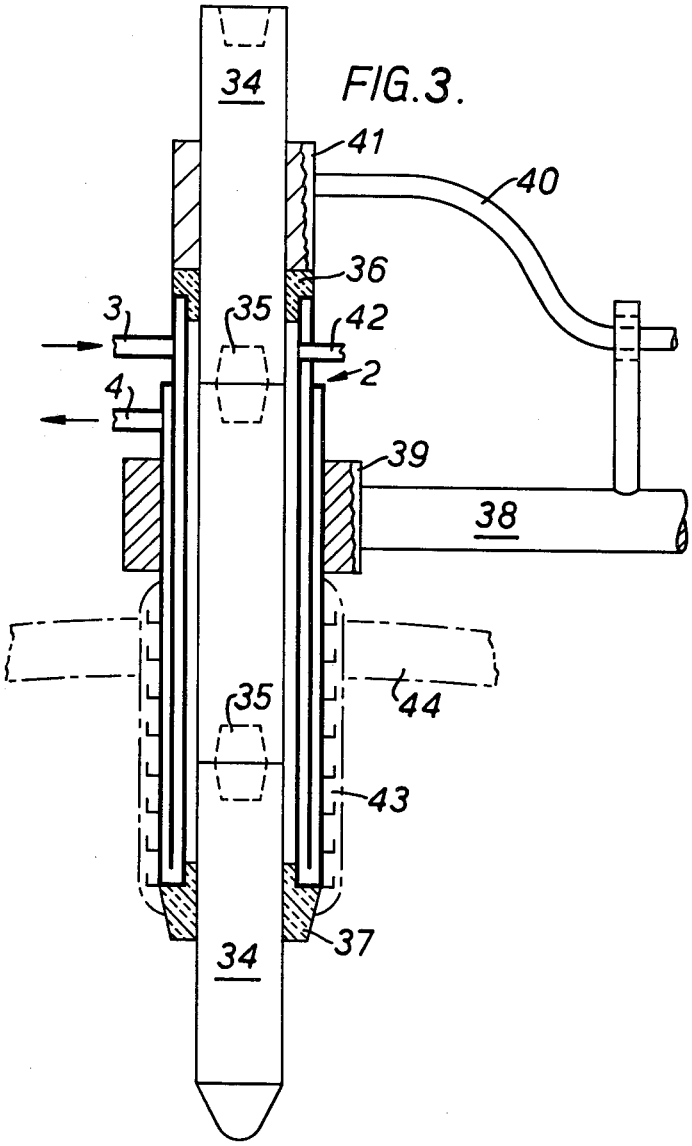

Referring now to FIG. 3, an elongated hollow tubular stainless steel structure 2 is water-cooled through inlet and outlet ports 3,4 as before, but in this instance extending through the centre of this structure is a plurality of elongated carbon or graphite sections 34 secured to another by graphite nipples 35. Refractory rings 36,37 are provided at the upper and lower ends of this structure which are loosely fitting around the graphite electrode column to permit it to be advanced downwardly in a manner to be described.

An electrode holder 38 is secured to the tubular structure by a clamp 39 and secured to and insulated from this holder is a bus tube 40 which in turn is electrically connected to the uppermost graphite section by a clamp 41.

An inert gas is injected through a port 42 into the space defined between the tubular structure and the electrode column to minimize oxidation and, as before, a refractory coating 43 is applied over the outer surface of the structure 2.

In operation, the whole assembly is advanced through the furnace roof 44 within the limits of travel of the electrode holder to regulate the arc current in the usual manner. When it is necessary to adjust the graphite column to allow for erosion the electrical clamp 41 is released the column is propelled through the structure which is in turn raised by the electrode holder to the limit of its travel again.

Figure 4:
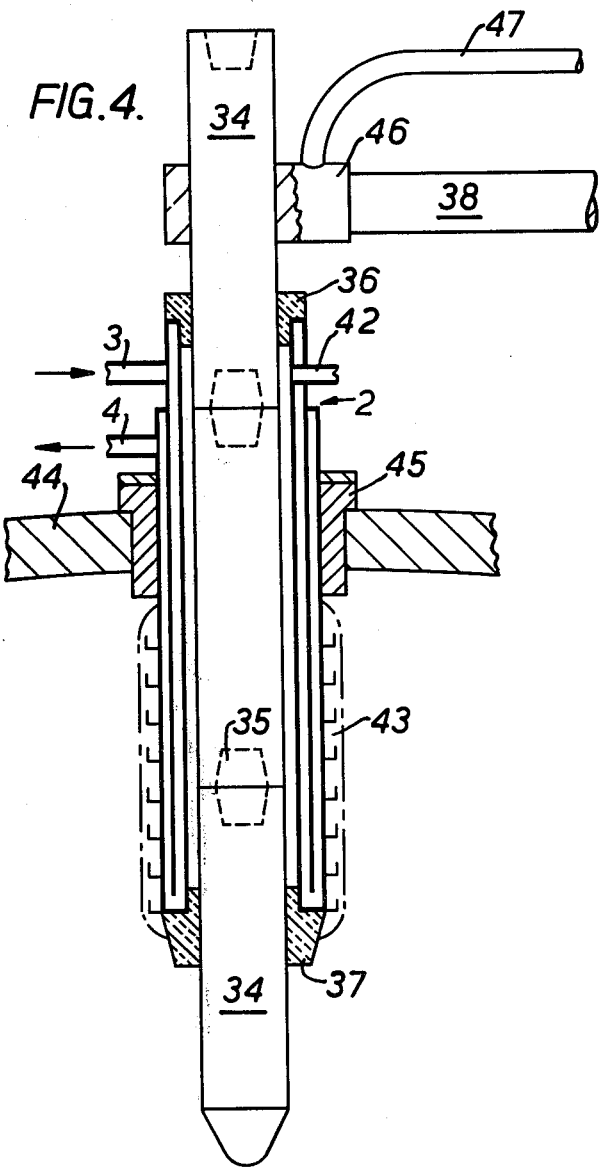

A modification of this arrangement is shown in FIG. 4. In this instance the casing assembly is fixedly mounted in the furnace roof 44 through a sleeve 45 and only the graphite electrode column is movable, namely, via the electrode holder 38 which is secured to this column by an electrically conductive clamp 46 to which a bus tube 47 is connected.

As with the FIGS. 1 and 2 embodiments a pressure sensor may be connected in circuit with the gas inlet port 42 to detect any significant drop in pressure which would identify a hazardous situation affecting the lower end of the water-cooled electrode.

Clearly, various modifications may be made to any of the designs described and illustrated without departing from the scope of this invention. For example the tubular steel structure could be smooth surfaced and itself be encased or sleeved with a refractory cylinder for protection instead of being provided with hooks for coating adherence. Further, many of the specific materials recited may be replaced with other equivalents, e.g. aluminium may be substituted for copper in some instances.

We claim:

1. An electrode for an arc furnace comprising a metal column including a pair of bus bars extending centrally through the column and a water cooled tubular structure surrounding and electrically insulated from the bus bars, said bus bars being connected to a conductive screw-threaded member at one end thereof, and a plurality of elongated dependent carbon or graphite sections, one of said sections being secured to the member, and that section, together with the other(s), being secured to one another through nipples having screw-threads of the same size as that of the said member.

2. An electrode according to claim 1, wherein the bus bars are in the form of tubes which are themselves water-cooled.

3. An electrode according to claim 2, wherein the screw-threaded member is traversed by the bus tube water cooling circuit.

4. An electrode according to claim 3, wherein the screw-threaded member is male threaded.

5. An electrode according to claim 3, wherein the screw-threaded member includes a female threaded portion and a threaded nipple secured to said portion, the first dependent graphite section being secured to this nipple.

6. An electrode according to claim 3, wherein the tubular structure is spaced from the bus bars, and in which an inlet port is provided on said structure for introducing an inert gas under pressure into said space, the said member defining a bore therethrough communicating with the said space whereby the gas may diffuse through the adjoining gas-permeable graphite section.

7. An electrode according to claim 6, wherein the said adjoining graphite section defines therein a blind bore extending to a substantial depth therein and communicating with the bore in said member.

8. An electrode according to claim 6, including sensor means for monitoring the gas pressure whereby to provide an indication of breakage or erosion of the graphite electrode sections identified by a significant reduction of said pressure.

9. An electrode according to claim 1, wherein the tubular structure is made from austenitic stainless steel or a magnetic material designed to minimise induced currents.

10. An electrode according to claim 1, wherein the external surface of the tubular structure is clad with a refractory material.

11. An electrode according to claim 1, wherein a refractory sleeve is provided around the said member.

12. An electrode for an arc furnace comprising a refractory clad column having dependent therefrom a number of inter-connected graphite sections, said column including a pair of centrally disposed water-cooled bus tubes and a metallic water-cooled tubular structure surrounding, spaced from and electrically insulated from the bus tubes, said bus tubes being connected to a conductive screw-threaded member to which one of said graphite sections is secured, that section, together with the other(s), being secured to one another through nipples having screw threads of the same size as that of the said member.

13. An electrode according to claim 12, in which an inlet port is provided in said tubular structure for introducing an inert gas under pressure into the space defined between the said structure and the bus tubes, the said screw-threaded member defining a bore therethrough communicating with said space whereby the gas may diffuse through the adjoining gas permeable graphite section, and in which sensor means is provided for monitoring the gas pressure.

14. An electrode for an arc furnace comprising a plurality of elongated graphite sections secured to one another by screw-threaded nipples, water-cooled tubular structure surrounding the said sections and insulating inserts at each end of the structure by which the structure is spaced from said sections, the structure being secured to the arc furnace through which it depends, a movable electrode clamp to which the graphite sections are secured by which the sections may be periodically advanced through said structure and said structure including inlet and outlet ports by which an inert gas is transmitted through the spacing between said structure and said sections.

15. An electrode for an arc furnace comprising a plurality of elongated graphite sections secured to one another by screw-threaded nipples, a water-cooled tubular structure surrounding the said sections and insulating inserts at each end of the structure by which the structure is spaced from the said sections, a holder to which the said structure is secured, an associated clamp for the graphite sections by which the sections may be periodically advanced through said structure and said structure including inlet and outlet ports by which an inert gas is transmitted through spacing between said structure and said sections.

* * * * *